US006419089B1

(12) United States Patent
Dall

(10) Patent No.: US 6,419,089 B1
(45) Date of Patent: Jul. 16, 2002

(54) EGG TRAY

(75) Inventor: Iwer Dall, Rømø(DK)

(73) Assignee: Brodrene Hartmann A/S (DK)

( * ) Notice: Subject to any disclaimer, the term of this patent is extended or adjusted under 35 U.S.C. 154(b) by 0 days.

(21) Appl. No.: 09/485,599

(22) PCT Filed: Aug. 4, 1998

(86) PCT No.: PCT/DK98/00340

§ 371 (c)(1),
(2), (4) Date: Feb. 14, 2000

(87) PCT Pub. No.: WO99/08944

PCT Pub. Date: Feb. 25, 1999

(30) Foreign Application Priority Data

Aug. 15, 1997 (EP) ..... 97114101

(51) Int. Cl.[7] ..... B65D 81/02
(52) U.S. Cl. ..... 206/521.1; 206/585
(58) Field of Search ..... 206/521.1, 521.6, 206/521.7, 521.8, 521.9, 523, 585

(56) References Cited

U.S. PATENT DOCUMENTS 3,207,409 A * 9/1965 Reifers et al. ..... 206/521.1
3,262,786 A * 7/1966 Weiss ..... 217/26.5
3,360,150 A * 12/1967 Schechter ..... 217/26.5
3,398,875 A * 8/1968 Snow et al. ..... 206/521.1
3,421,682 A * 1/1969 Eisenbach ..... 206/521.1
3,674,168 A * 7/1972 Padovani ..... 217/26.5
3,715,071 A * 2/1973 Flynn ..... 217/26.5
3,771,712 A * 11/1973 Richards ..... 217/26.5
3,877,599 A * 4/1975 Morris ..... 217/26.5
4,059,219 A * 11/1977 Reifers et al. ..... 206/521.1
4,355,731 A * 10/1982 Carroll et al. ..... 206/521.6
4,465,225 A * 8/1984 Bixler et al. ..... 206/521.6
4,650,076 A * 3/1987 Padovani ..... 206/526

* cited by examiner

*Primary Examiner*—Shian Luong
(74) *Attorney, Agent, or Firm*—Larson & Taylor, PLC

(57) ABSTRACT

An improved egg tray is disclosed. The egg tray is comprised of a thin-walled body of rigid fiber pulp material and has a plurality of pockets and a plurality of posts. Each pocket has a bottom surrounded by a plurality of posts and each pocket has an egg-supporting surface for supporting an egg. The egg-supporting surface is a continuous part of a substantially ellipsoidal surface approximating the surface of the pointed part of an egg, and the pockets are within an egg size interval for which the egg tray is intended to be used. The egg-supporting surface has a continuous circular zone and a plurality of lower tongues extending downwardly from the continuous zone. Advantageously, the egg-supporting surface has a plurality of upper tongues extending upwardly on the sides of the posts from the continuous zone.

18 Claims, 3 Drawing Sheets

EGG TRAY

FIELD OF THE INVENTION

The present invention relates to an egg tray of the kind set forth in the preamble of claim 1.

BACKGROUND OF THE INVENTION

Egg trays of the kind referred to above normally comprise thirty pockets arranged in five rows of six pockets each. They are normally used by the egg producers for packaging eggs to be delivered to e.g. a wholesale distribution site comprising a packaging station. The egg producers fill the egg trays manually or by using suitable machinery, while at the packaging station, the eggs are removed mechanically in machines normally using arrays of suction cups, in the example referred to arranged in five rows of six cups each, for transferring the eggs from the egg trays supplied by the producer to a quality and grading control stage and from there to a final packaging stage, in which the eggs are placed in e.g. smaller egg cartons suitable for sale in retail shops.

In previously known egg trays of the kind referred to initially, the egg-supporting surface consists of a number of abutment regions on the sides of the posts forming the pockets between them. These abutment regions are small and are distributed on said sides, and do not always conform closely to the ellipsoidal surface of an egg, thus creating a risk of breakage due to individual abutment regions, especially at their edges, being pressed into the eggshell, the latter being unable to resist such a concentrated load. This problem is not made less serious by the fact that a new size classification for eggs has been introduced. According to this new classification, an egg tray of a given size is expected to accommodate eggs within a size interval that is greater than was the case with the previous classification. When using the previously known egg trays, this may result in that many eggs, especially the smallest ones within the class concerned, will not come to rest steadily in the egg-supporting surface or other surfaces. This risk of instability is particularly important when at the production site manually or mechanically placing the eggs in the egg trays, as it is important, not only with regard to placing another egg tray on top of one having just been filled, that the eggs having been deposited in the pockets automatically assume a steady and predictable orientation, but also with regard to the mechanized packaging subsequently taking place at the packaging station, in which the eggs are lifted from the trays by means of suction cups as described in the preceding paragraph.

Various attempts have been made to solve these problems, such as by increasing the size of the various abutment regions, but these attempts have only met with limited success, presumably because the number of abutment regions, and in particular the number of edges, has not been appreciably reduced, so that the risk of breakage or instability has not been reduced to any considerable extent.

SUMMARY OF THE INVENTION

It is the object of the present invention to provide an egg tray of the kind referred to initially, with which the disadvantages referred to above are considerably reduced, and this object is achieved with an egg tray of said kind, comprising only one single abutment region constituted by the continuous ellipsoidal or quasi-ellipsoidal surface, on which the eggs when deposited will come to rest in stable and predictable orientations, with their weight more or less evenly distributed over the entire surface, thus avoiding both local stress concentrations and instability, as well as ensuring a good engagement with the suction cups used to remove the eggs from the trays.

Other advantageous features of the egg tray acccording to the invention are also described.

BRIEF DESCRIPTION OF THE DRAWINGS

In the following detailed part of the present description, the invention will be explained in more detail with reference to the exemplary embodiment of an egg tray shown in the drawings, of which

DETAILED DESCRIPTION OF THE PREFERRED EMBODIMENT

Figure 1:
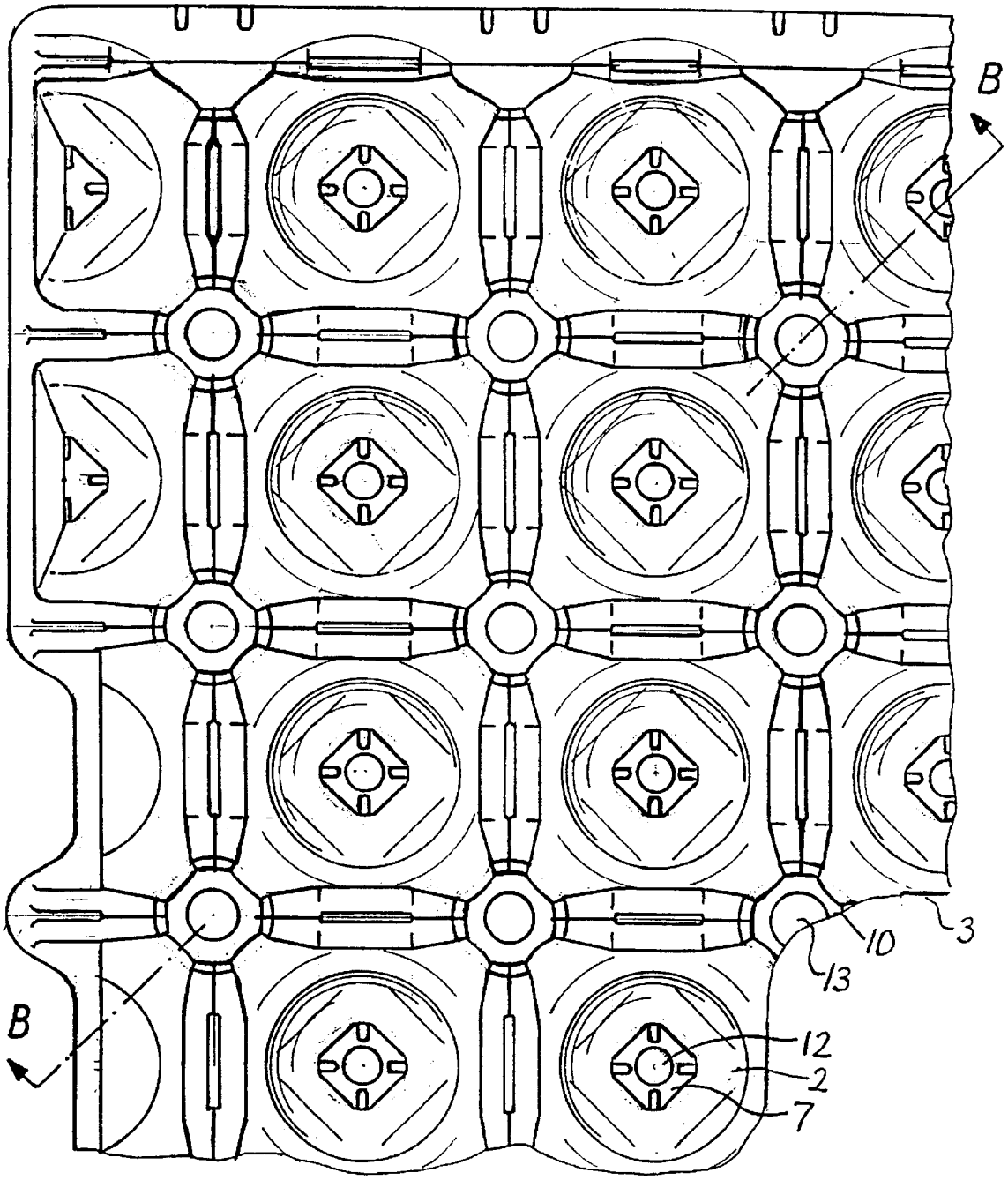
FIG. 1 is a plan showing a corner region of the egg tray.

The egg trays 1 shown in the drawing consist in a manner known per se of a rigid, thin-walled body, made by aspirating an aqueous fibre pulp onto a perforated mould and then consolidating and drying the body thus formed.

Each tray comprises, likewise in a manner known per se, a plurality of pockets 2 and posts 3 arranged in a regular pattern, that is normally orthogonal, i.e. having pockets and posts arranged in rows crossing each other at right angles, but other patterns, such as a hexagonal "honeycomb" pattern, may also be used. In the embodiment shown, the normal orthogonal arrangement is used, so that each pocket is surrounded by four posts 3, and each post 3 is—except at the edges surrounded by four pockets 2.

Figure 3:
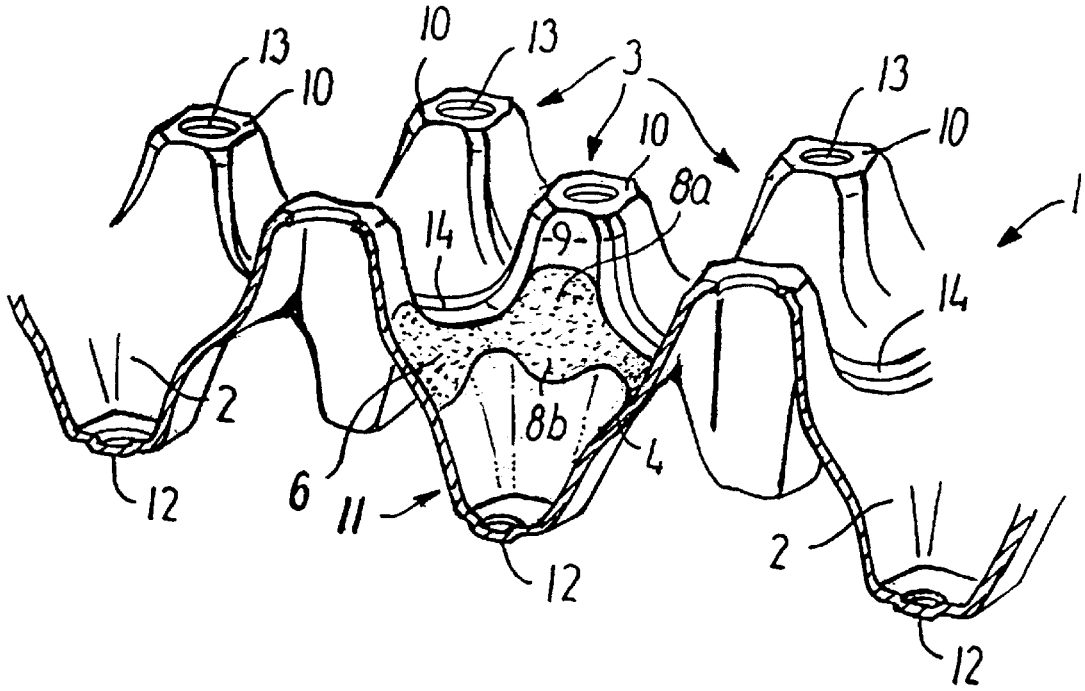
FIG. 3 is a perspective view showing part of an egg tray cut along a diagonal line to show details of the pockets and posts forming the tray.

One important feature of the egg tray 1 is the shape of the egg-supporting surface 6,8*a*,8*b* shown stippled in one of the pockets 2 in FIG. 3. In order to support an egg 5 (not shown in this particular pocket 2) as gently and steadily as possible, this surface 6,8*a*,8*b* is a part of a circular ellipsoid, i.e. a surface described by an ellipse rotating about one of its axes, or a surface closely approximating such an ellipsoid. Such a surface has proved to be a close approximation to the shape of the "pointed" end of a hen's egg. The egg-supporting surface 6,8*a*,8*b* consists of three parts, i.e.

- a continuous zone 6 extending from a first level I at a distance of approximately 22 mm above the level of the pocket bottom 7 to a second level 11 at a distance of approximately 25 mm above said bottom 7,
- a number of, in the present case four, upper protuberances or tongues 8*a* extending upwardly on the sides of the respective posts 3 in continuation of the zone 6 from the second level II to a third level III at a distance of approximately 33 mm from the bottom 7, and
- an equal number of, in the present case four, lower protuberances or tongues 8*b* extending downwardly on the internal sides of the lower part 11 of the respective pocket 2 to a fourth level IV at a distance of approximately 20 mm from the bottom 7

It should be noted that said approximate dimensions may vary depending on the size of eggs within the class, with which the egg tray 1 is to be used.

The continuous zone 6, together with the lower tongues 8*b*, has proved to provide reliable support in the downward direction, i.e. against the force of gravity and dynamic forces created, when at the production site, e.g. a poultry farm, the egg tray concerned is being filled with eggs, either manually or using a suitable machine, so that they automatically assume a stable upright position centered in the respective pockets 2. Similarly, when the egg tray is placed on a table in a not too gentle manner, the upper tongues 8*a* will keep the eggs steady against forces directed sideways, such as dynamic forces created e.g. when the egg tray is pushed sliding on a shelf against a wall. This means that the eggs, when arriving at the packaging station in e.g. a wholesale distribution site, will remain in the correct orientation in the egg trays, thus ensuring a safe encounter with the suction cups used in this station for transferring the eggs to e.g. smaller egg cartons for distribution to retail shops. At the same time, the open spaces between the upper tongues 8*a*, i.e. between the respective posts 2, and above the continuous zone 6, the upper limit of which is said second level 11, allow visual access to a large proportion of the surface of the eggs when viewed at an acute angle from above.

At the third level III, the upper tongues 8*a* pass smoothly into substantially conical surface segments 9. These act as lead-in surfaces when placing the eggs in the pockets, thus reducing the risk of breakage by collision with the tops 10 of the respective posts 3.

Figure 2:
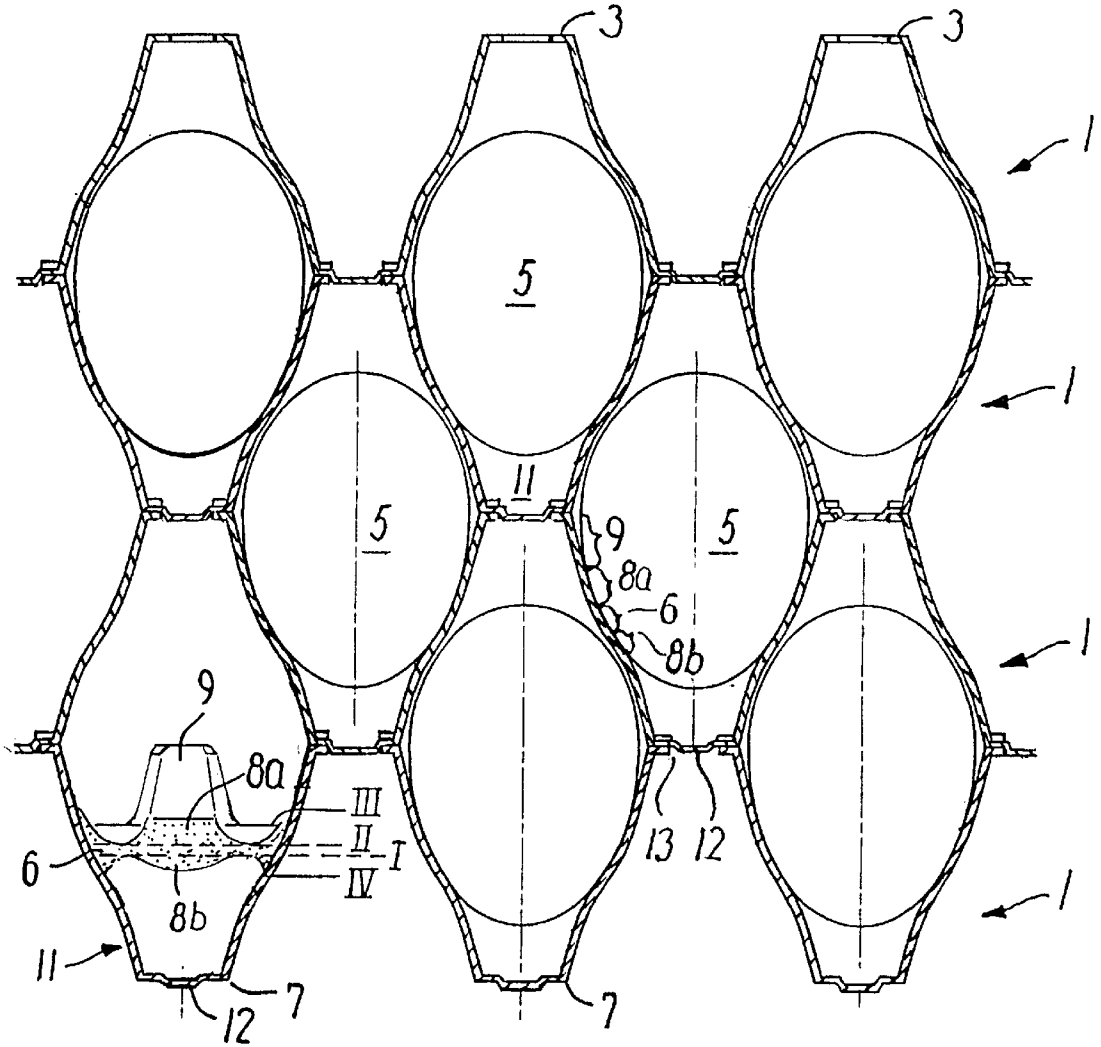
FIG. 2 is a sectional view showing four egg trays stacked on one another, of which the lower three contain eggs, the section being a diagonal one taken along lines corresponding to the line B—B in FIG. 1.

Another important feature of the egg tray 1 is the shape of the lower part 11 of each pocket 2. In the embodiment shown, this lower part 11 is of generally square cross section, symmetrical about the vertical axis of the continuous zone 6, and extends from the pocket bottom 7 at a slightly obtuse angle, flaring upwardly and outwardly to merge into the lower tongues 8*a* at the fourth level IV and into the continuous zone 6 at the first level I. In fact, it is the external shape of the lower part 11 that is important in the present connection. As may be seen from FIG. 2, cf. especially the right-hand egg 5 in the middle row, the lower part 11 of a pocket in an egg tray 1 above the one, in which this particular egg 5 rests, lies very close to a part of the upper half of the egg, thus improving safety. On the other hand, sufficient clearance must be provided to prevent the lower part 11 from pressing locally on an egg in a pocket in a lower tray. The lower part 11 could also be rounded or round, provided that its external shape fulfils the function explained above.

As always when egg trays containing eggs are to be stacked, the trays must be properly aligned in order to avoid damage to the eggs. One way of achieving this is to provide downwardly protruding projections 12 adapted to fit into holes 13 in the tops 10 of the posts 3 of the next egg tray below.

Before use, egg trays of this type are normally closely stacked or "nested", the pockets and posts of each tray fitting closely into the pockets and posts of the tray lying below and above, respectively. To make it easy to remove single trays from the stack, egg trays are normally provided with some kind of "de-nesting" feature, and in the egg tray 1 shown, crescent-shaped denesting ribs 14 extend between the various posts 3 mid-way between the egg-supporting surfaces 6,8*a*,8*b* in respective pockets 2. The ribs 14 are not hollow—persons skilled in the art of moulding fibre-pulp articles will know how to achieve this—and will constitute spacers keeping the egg trays in a stack at a distance from each other, thus preventing too close mutual engagement of the relatively rough surfaces on the posts and in the pockets.

LIST OF PARTS

1 egg tray
2 pocket
3 post
5 egg
6 continuous zone
7 pocket bottom
8*a* upper protuberance/tongue
8*b* lower protuberance/tongue
9 conical surface segment
10 top
11 lower part (of 2)
12 projection
13 hole
14 denesting rib
I first level
II second level
III third level
IV fourth level

What is claimed is:

1. An egg tray having a thin-walled body of rigid fiber pulp material and having surfaces for supporting the ellipsoidal surface of an egg, said egg tray comprising:

a plurality of pockets each having a bottom and surrounded by a plurality of posts extending upwardly from said pockets in a direction opposite said bottom;

an egg-supporting surface for supporting the egg and having a continuous substantially ellipsoidal surface approximating the ellipsoidal surface of the egg, said continuous substantially ellipsoidal surface having a continuous circular zone and a plurality of lower tongues extending downwardly from said continuous circular zone into a flared surface, said continuous circular zone and said lower tongues formed within said pocket; and said continuous substantially ellipsoidal surface also having a plurality of upper tongues extending upwardly from said continuous circular zone, along a side surface of said posts, and out of said pocket.

2. An egg tray having surfaces for supporting the ellipsoidal surfaces of an egg and having a thin-walled body of rigid fiber pulp material, said egg tray comprising:

a plurality of pockets each surrounded by a plurality of posts and having a bottom, each of said plurality of posts having a top;

an egg-supporting surface for supporting the egg and having a continuous substantially ellipsoidal surface approximating the ellipsoidal surface of the egg, said continuous substantially ellipsoidal surface having a continuous circular zone and a plurality of lower tongues extending downwardly from the continuous zone, said continuous circular zone and said lower tongues formed within said pockets; and said continuous substantially ellipsoidal surface also having a plurality of upper tongues extending upwardly from the continuous zone, each said tongue extending out from said pocket, and along a side surface of a respective post.

3. The egg tray according to claim 2, wherein each of the posts is comprised of at least one conical surface segment extending from each upper tongue to said top of each post, respectively.

4. The egg tray according to claim 2, wherein each lower tongue is in contact with a part having a flared shape with an interior surface facing said pocket and an exterior surface facing away from said pocket, wherein said interior surface extends downwardly from each lower tongue to a substantially flat bottom, and wherein the substantially flat bottom is adapted for resting on a top of a second egg tray of the same kind located beneath the first tray when the first egg tray is placed on top of the second egg tray, and wherein said exterior surface is shaped and placed so as to be in proximity to an upper surface part of an egg placed in a pocket in the second egg tray.

5. The egg tray according to claim 2, further comprising a plurality of crescent-shaped denesting ribs located between the pockets and extending from each post to a next post so as to interconnect the posts and for providing ease of separation of each egg tray from a second egg tray to which each said egg tray is connected.

6. The egg tray according to claim 5, wherein the upper limit of the continuous zones and an upper edge of the denesting ribs are sufficiently low so as to allow a substantial portion of the eggs placed in the pockets to be visible when viewing the egg tray at an acute angle from above.

7. The egg tray according to claim 2, further comprising:

accepting means located at respective tops of the posts for accepting an egg tray of the same type from above, wherein the accepting means are selected from a group consisting of rounded hollow areas and recessions; and projections projecting downward from the respective bottoms of the pockets for engaging the accepting means of a second egg tray.

8. The egg tray according to claim 2, wherein said egg-supporting surface has a shape and size sufficient for the egg tray to support a plurality of eggs of a specific size and species so as to assure that the plurality of eggs placed in the pockets of the tray will automatically assume a centered upright position.

9. The egg tray according to claim 2, wherein the pockets and posts are arranged in a regular orthogonal pattern, wherein each pocket is surrounded by four posts.

10. The egg tray according to claim 2, wherein the continuous circular zone of each pocket extends from about 22 mm from said bottom of said pocket to about 25 mm from said bottom, and wherein the upper tongues extend from the top of the continuous zone to about 33 mm from said bottom, and wherein the lower tongues extend from said continuous circular zone to about 20 mm from said bottom.

11. An egg tray for supporting the ellipsoidal surfaces of an egg, said egg tray comprising:

a plurality of pockets each having a bottom and surrounded by a plurality of posts extending upward from said pockets in a direction opposite said bottom, each of said posts having a top;

each said pocket having an egg-supporting surface for supporting the egg and having a continuous substantially ellipsoidal surface approximating the ellipsoidal surface of the egg, said continuous substantially ellipsoidal surface having a continuous circular zone and a plurality of lower tongues extending downwardly from the continuous zone, both said continuous circular zone and said plurality of tower tongues formed within said pocket; and said continuous substantially ellipsoidal surface also having a plurality of upper tongues extending upwardly from said continuous circular zone out of said pocket and along a side surface of said posts;

each said lower tongue in contact with a part having a flared shape with an interior surface facing said pocket and an exterior surface facing away from said pocket, said interior surface extending downwardly from each lower tongue to a substantially flat bottom, said substantially flat bottom adapted for resting on a top of a second egg tray of the same kind immediately beneath the first egg tray when the first egg tray is placed on top of the second egg tray, said exterior surface shaped and placed so as to be in proximity to an upper surface part of an egg placed In a pocket in the second egg tray.

12. The egg tray according to claim 11, wherein each of the posts is comprised of at least one conical surface segment extending from each upper tongue to the top of each post, respectively.

13. The egg tray according to claim 11, further comprising a plurality of crescent-shaped denesting ribs located between the pockets and extending from each post to a next post so as to interconnect the posts and for providing ease of separation of each egg tray from a second egg tray to which each said egg tray is connected.

14. The egg tray according to claim 13, wherein the upper limit of the continuous zones and an upper edge of the denesting ribs are sufficiently low so as to allow a substantial portion of the eggs placed in the pockets to be visible when viewing the egg tray at an acute angle from above.

15. The egg tray according to claim 11, further comprising;

accepting means located at respective tops of the posts for accepting an egg tray of the same type from above, wherein the accepting means are selected from a group consisting of rounded hollow areas at the post tops and recessions; and projections projecting downward from the respective bottoms of the pockets for engaging the accepting means of a second egg tray.

16. The egg tray according to claim 11, wherein said egg-supporting surface has a shape and size sufficient for the egg tray to support a plurality of eggs of a specific size and species so as to assure that the plurality of eggs placed in the pockets of the tray will automatically assume a centered upright position.

17. The egg tray according to claim 11, wherein the pockets and posts are arranged in a regular orthogonal pattern, wherein each pocket is surrounded by four posts.

18. An egg tray according to claim 11, wherein said continuous circular zone extends from about 22 mm of said pocket to about 25 mm from said bottom, said upper tongues extends from said continuous circular zone to about 33 from said bottom, and said lower tongues extends from said continuous zone to about 20 mm from said bottom.

* * * * *